US006082593A

United States Patent [19]

Borcherds

[11] Patent Number: 6,082,593

[45] Date of Patent: Jul. 4, 2000

[54] LOW MAINTENANCE COSMETIC DISPENSER WITH A SLIDEABLE NOZZLE HOOD

[75] Inventor: Cedric M. Borcherds, Tullamurra, Australia

[73] Assignee: Jean Charles, Inc., Thermal, Calif.

[21] Appl. No.: 08/945,787

[22] PCT Filed: Feb. 27, 1997

[86] PCT No.: PCT/AU97/00119

§ 371 Date: May 1, 1998

§ 102(e) Date: May 1, 1998

[87] PCT Pub. No.: WO97/31563

PCT Pub. Date: Sep. 4, 1997

[51] Int. Cl.[7] ..... B67D 5/06

[52] U.S. Cl. ..... 222/181.3; 222/321.6; 222/321.9; 222/325

[58] Field of Search ..... 222/325, 181.3, 222/153.09, 153.01, 321.7, 321.9, 132, 153.03

[56] References Cited

U.S. PATENT DOCUMENTS

| | | | |
|---|---|---|---|
| 2,772,817 | 12/1956 | Jauch . | |
| 3,349,967 | 10/1967 | Schneller | 222/132 X |
| 3,720,352 | 3/1973 | Kozlowski | 222/132 |
| 4,391,308 | 7/1983 | Steiner | 222/325 X |
| 4,773,569 | 9/1988 | Larsson . | |
| 4,964,544 | 10/1990 | Hanna . | |
| 5,368,200 | 11/1994 | De Winter . | |
| 5,489,044 | 2/1996 | Ophardt | 222/325 X |

FOREIGN PATENT DOCUMENTS

| | | |
|---|---|---|
| 14315/92 A1 | 8/1992 | Australia . |
| 41074/93 A1 | 11/1993 | Australia . |
| 54604/94 A1 | 6/1994 | Australia . |
| 2315018 | 1/1977 | France . |
| 808722 | 2/1957 | United Kingdom . |
| 1186314 | 4/1970 | United Kingdom . |

*Primary Examiner*—Gregory L. Huson

*Attorney, Agent, or Firm*—Blakely Sokoloff Taylor & Zafman LLP

[57] ABSTRACT

A cosmetic dispenser which has one or more cosmetic cartridges that can be removed from a dispenser cabinet when the cosmetic substance within the cartridge has become depleted. The cabinet has a cover that is pivotally connected to a base. The base is typically mounted to a wall of a hotel bathroom. The cover encloses the cosmetic cartridges that are located within an inner cavity of the cabinet. The cosmetic cartridges are secured to the base by a plurality of spring latch fingers which can be deflected to attach and remove the cartridge from the cabinet. Each cartridge has a reciprocal piston pump sealingly engaged in a neck of the cartridge, the pump being actuable by depression of a hollow dispensing nozzle connected to the piston of the pump. The piston pump may be a conventional dispenser pump of a top dispensing container modified by fluidically sealing air vents provided in the pump body adjacent one end remote from a check valve located at an opposite end.

18 Claims, 4 Drawing Sheets

FIG. 3
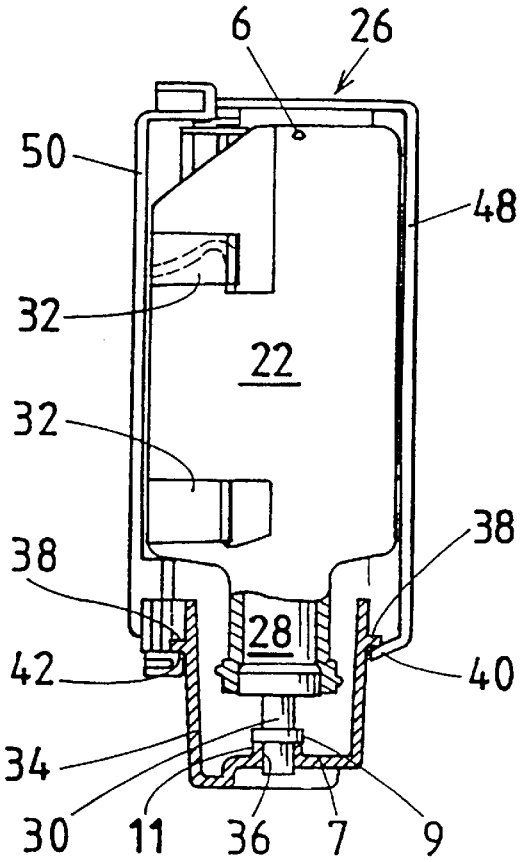
FIG. 4
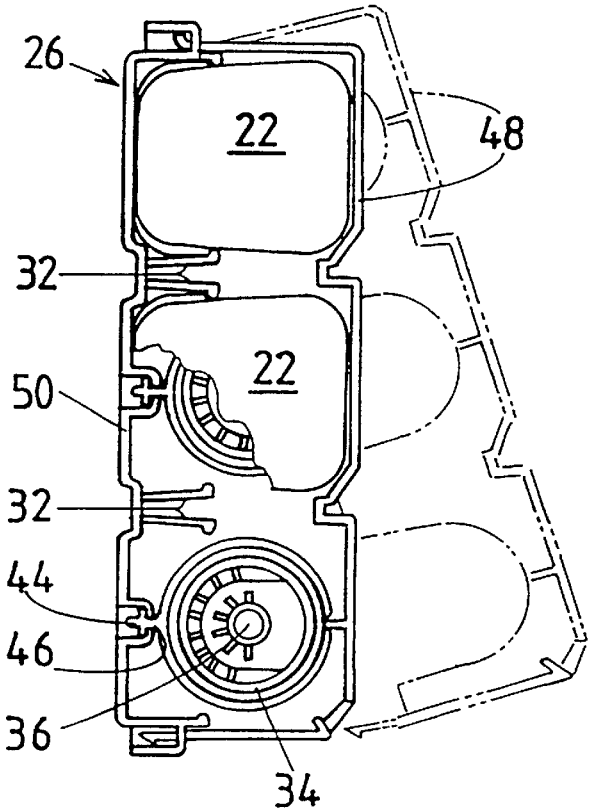
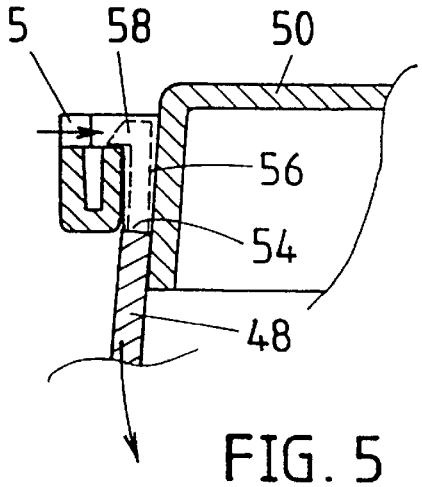
FIG. 5
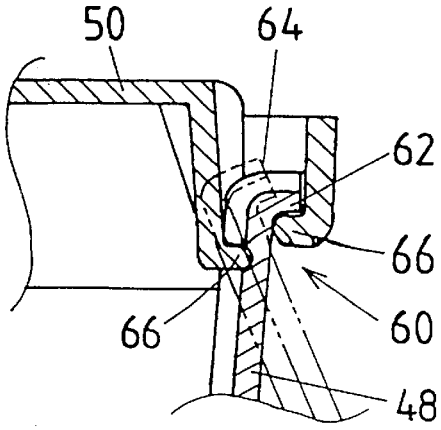
FIG. 6

LOW MAINTENANCE COSMETIC DISPENSER WITH A SLIDEABLE NOZZLE HOOD

FIELD OF THE INVENTION

The present invention relates to a dispenser for dispensing cosmetic substances.

BACKGROUND OF THE INVENTION

Hotel rooms are typically supplied with various cosmetic products such as body lotions, soaps, shampoos, etc. The cosmetics are typically packaged within individual containers that are provided as a complimentary item by the hotel proprietor. For sanitary reasons the containers must be discarded when the seal is broken, even if a bottle still contains lotion, shampoo, etc. The hotel supplies a new set of cosmetic bottles after each room occupancy.

The discarded unused cosmetic products represents a waste that increases the cost of operating the hotel. Additionally, the separate bottles increase the cost of maintaining the rooms and the waste storage space in general.

There has been marketed soap dispensers that are mounted to the wall of hotel rooms. The dispensers typically have a pump which ejects a volume of cosmetic product when a pump tip is depressed by the hotel patron. The dispenser is replenished by removing a cover and pouring the cosmetic product into a dispenser reservoir. Removing the cover and pouring the cosmetics can be a time consuming operation, particularly when repeated in a number of rooms within a hotel. The additional time required to fill the dispensers increase labor cost and the operating expense of the hotel. Additionally, the dispensers tips tend to accumulate dirt which must be cleaned by the hotel personnel, further increasing the operating expense.

Other types of prior art cosmetics dispensers include disposable containers which overcome at least some of the shortcomings of the aforementioned reservoir dispensers.

Generally speaking disposable container dispensers fall into two categories a rigid or semi rigid container connected to a separate pump mechanism and a flexible container having a flexible neck which forms part of the dispenser pump mechanism.

Typical prior art cosmetics dispensers are disclosed in patent specifications GB 1434095, U.S. Pat. No. 5,273,186, U.S. Pat. No. 4,886,192, U.S. Pat. No. 5,242,083, AU-A-81740/91, U.S. Pat. No. 4,778,085, U.S. Pat. No. 4,324,349 and DE 3333569 A1.

GB 1434095 describes a cream soap dispenser with a hollow body which receives an inverted container having a screw threaded neck which is received in a screw threaded socket in the base of the housing. A displaceable plug is located in the neck of the container and is displaced by a spike when the container is screwed into the socket thereby allowing liquid soap to flow into an internal soap chamber in the base of the housing. The soap chamber is in fluid communication with a lever actuated piston pump and nozzle assembly formed integrally with the housing. The pump and nozzle have separate check valves for filling the pump cylinder.

U.S. Pat. No. 5,273,186 describes a portable hand held dispenser for one handed dispensing of controlled quantities of a concentrated liquid detergent into a container of water to produce a diluted cleaning liquid of predetermined strength. This apparatus comprises a body with a rack and pinion operated piston pump and a removable cartridge having a flexible pouch therein to contain concentrated detergent. The body has a hollow needle connected to the pump to pierce a membrane in an output nozzle of the cartridge.

U.S. Pat. No. 4,886,192 is concerned with a soap dispenser having a wall mounted bracket with a lever and piston device to actuate a flexible dispensing nozzle. The dispensing nozzle is connected to a tank which may be filled directly with liquid soap or the tank may receive a disposable cartridge. A plurality of ribs with cutting edges extend upwardly from the base to pierce a sealed cap on the cartridge as it is inserted to release liquid soap into the tank.

U.S. Pat. No. 5,242,083 discloses a liquid dispensing system having a housing which supports therein a disposable flexible pouch. A pivoted actuating arm compresses a flexible peristaltic pumping tube formed integrally with the pouch. A mechanical check valve arrangement coacts with the actuating arm to open a flat or "duck bill" nozzle at the end of the tube and thereafter to create a suck back to prevent drips.

AU-A-81740/91 describes a similar system to that of U.S. Pat. No. 5,242,083 except that the flexible peristaltic tube pump is formed as an attachment to the flexible pouch. A mechanical check valve is provided in the tip of the pump nozzle to avoid drainage of the pouch contents. U.S. Pat. No. 4,778,085 is directed to a peristaltic dispensing nozzle connected to an exposed rigid or semi-rigid bottle supported on top of a dispenser housing. The dispensing nozzle is screw threadably connected to a threaded neck of the bottle.

U.S. Pat. No. 432,439 describes a liquid dispenser supported in an inverted position by a screw threaded connection between the neck of a flexible bottle and a socket in the top of a support base. An air chamber is formed between a dispensing nozzle and the interior of the bottle to avoid leakage after dispensing a quantity of liquid by manually squeezing the flexible bottle.

DE 3333569 A1 discloses a liquid dispenser having a flexible bottle squeezable between a projection on an actuator and a projection on the interior wall of the dispenser housing. A two way check valve system permits dispensing of liquid under actuator pressure by a first check valve. A second check valve located within the first check valve permits ingress of air to equalise pressures and both the first and second check valves prevent leakage under gravitational pressure.

While most of the prior art systems are generally satisfactory for their intended purpose, they all suffer from one or more disadvantages.

It would be desirable to provide a cosmetic dispenser which is more cost efficient and sanitary than dispensers of the prior art and which is otherwise easier to refill and simpler and more reliable in use.

SUMMARY OF THE INVENTION

According to one aspect of the invention there is provided a cosmetics dispenser comprising:

housing having a base member and a cover member pivotally attached thereto to define a hollow interior;

one or more cosmetic cartridges removable securable in an inverted position within said hollow interior, said one or more cosmetic cartridges each having a reciprocable piston pump sealingly engaged in a neck of a respective cartridge, said pump in use being actuable by depression of a hollow dispensing nozzle connected to a piston of said pump.

Suitably said cover member and said base member are releasably securable in a closed position by a latch member.

Preferably the latch member is hidden when the cover member is closed and an unobtrusive access is provided for release of said latch member.

The one or more cartridges may be releasably securable in said base member.

Alternatively the one or more cartridges may be releasably securable in said cover member.

Suitably said one or more cartridges are secured in said housing by resiliently deformable latch fingers associated with said housing.

Preferably said one or more cartridges are secured in said housing by resiliently deformable spring latch fingers releasably engagable with corresponding contours on a surface of said one or more cartridges.

The dispenser may comprise a nozzle hood associated with a respective nozzle, said nozzle hood being slidably engagable with said housing.

The nozzle hood may be captively engaged with said housing when said cover member is closed and releasable when said cover member is open.

Suitably the nozzle hood includes a nozzle aperture in a lower face to receivably locate a free end of a respective nozzle, said pump in use being actuable by depression of said nozzle hood.

Preferably said nozzle hood includes a forwardly facing recess surrounding said nozzle aperture to direct, in use, a cosmetics substance onto a user's fingers in the direction of the user's palm.

Preferably said one or more cartridges each include an air vent located in a normally upper region thereof.

The air vent may include a removable sealing member.

The removable sealing member may be adhesively secured to a respective cartridge.

The removable sealing member may comprise a hollow protrusion extending outwardly of a wall of a respective cartridge.

Suitably the piston pump is integrally formed with a screw threaded closure sealingly engagable with a screw threaded neck on a respective cartridge.

If required the piston pump may comprise a cylindrical body sealingly engagable with the neck of a respective cartridge.

Preferably the piston pump does not include operative air vents communicating between a normally lower region of the pump body and the interior of a respective cartridge.

Most preferably the piston pump is in fluid communication with the interior of a respective cartridge only via a check valve located in a normally upper portion of said pump body.

Suitably the piston pump comprises a conventional dispenser pump for a top dispensing container said dispenser pump characterised in that air vents provided in the pump body adjacent one end remote from a check valve located at an opposite end are fluidically sealed.

If required the air vents may be fluidically sealed by an elastomeric seal located between the pump body and an interior wall of a respective container.

Suitably the dispenser pump is further characterised by the removal of a feeder tube spigot adjacent the check valve.

BRIEF DESCRIPTION OF DRAWINGS

The objects and advantages of the present invention will become more readily apparent to those ordinarily skilled in the art after reviewing the following detailed description and accompanying drawings, wherein:

FIG. 3 is a cross-sectional side view taken at line 3—3 of FIG. 1;

FIG. 4 is a cross-sectional top view taken at line 4—4 of FIG. 1;

FIG. 5 is an enlarged sectional view showing a latch of the cover;

FIG. 6 is an enlarged sectional view showing a pivot joint of the cover.

DETAILED DESCRIPTION

Figure 1:
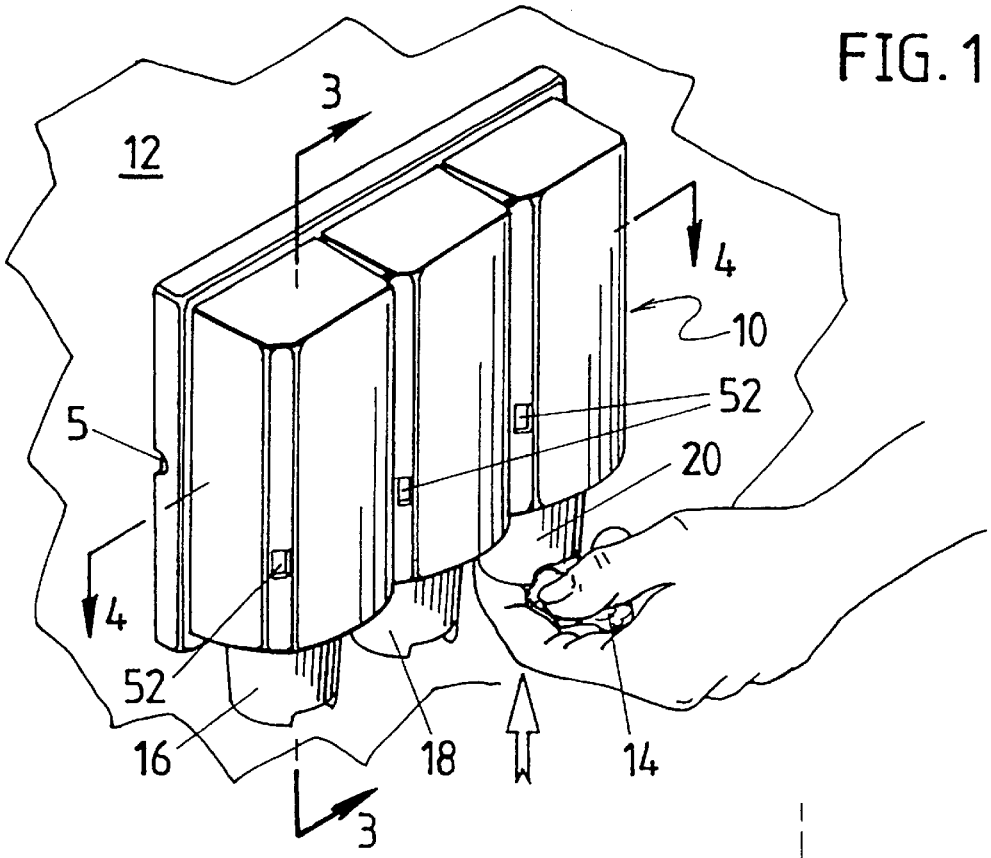
FIG. 1 is a perspective view of a cosmetic dispenser of the present invention.

Referring to the drawings more particularly by reference numbers, FIG. 1 shows a cosmetic dispenser 10 of the present invention. The dispenser 10 is typically mounted to a wall 12, such as a bathroom wall of a hotel or motel room. Although use within a hotel room is described, it is to be understood that the dispenser 10 of the present invention may be used in any structure. The dispenser 10 discharges a volume of a cosmetic substance 14 on the hand of an end user. The cosmetic substance 14 may be a body lotion, shampoo, soap or any other similar product. The dispenser 10 may contain three separate outlets 16, 18 and 20 that eject three different cosmetic substances such as a soap, a shampoo and a body lotion. Although three separate outlets are shown and described, it is to be understood that the dispenser 10 may have any number of outlets.

Figure 2:
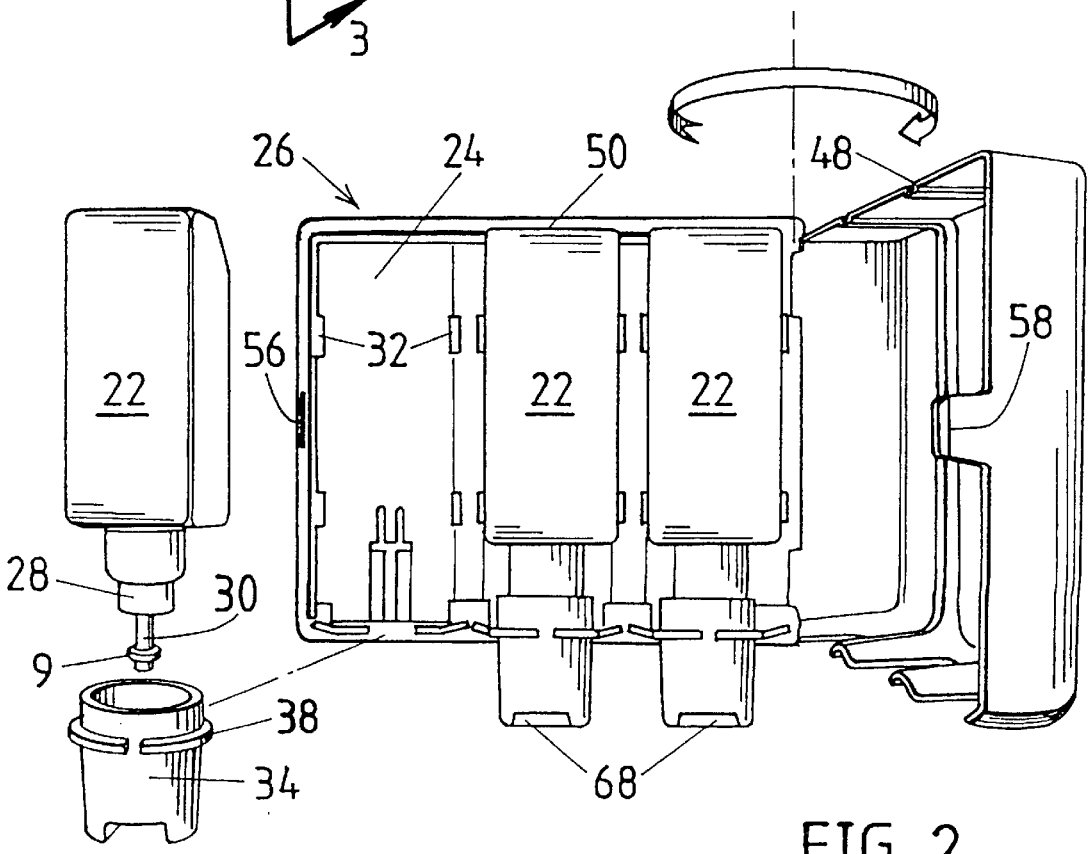
FIG. 2 is a front view of the dispenser with a cover rotated to an open position.

As shown in FIGS. 2–4, the dispenser 10 has a plurality of cosmetic cartridges 22 located within an inner cavity 24 of a cabinet 26. Each cartridge 22 contains a cosmetic substance. The cartridges 22 are constructed from a transparent, or at least a translucent plastics material which allows a user to see the amount of cosmetic substance that is within the cartridge 22. Located at one end of each cartridge 22 is a pump 28 which is described in detail with reference to FIGS. 7 and 8. The pump 28 has a tip 30 which discharges a cosmetic substance when the tip 30 is depressed. Pump 28 does not have breather ports so that cosmetics do not leak from the inverted cartridge. The top of the cartridge 22 has a vent 6 that allows air to flow therein as the liquid volume diminishes. Other than vent 6 the cartridge is otherwise sealed to prevent the cosmetic substance from spilling when the cartridge is being replaced. The cartridge 22, cosmetic substance 14 and pump 28 are typically provided as a single disposable unit.

The cartridges 22 are attached to the cabinet 26 by a plurality of resilient latch fingers 32. The fingers 32 are deflected to apply a biassing force that holds the cartridges 22 firmly in position. The cosmetic cartridges 22 can be removed by merely pulling the cartridges 22 away from the fingers 32. The resilient fingers 32 deflect to allow for the easy removal of the cartridges 22.

The nozzles 30 of cartridges 22 are supported in respective hoods 34 slidably located adjacent the base of the cabinet 26. The hoods 34 each have a shouldered opening 36 that allow the free ends of nozzle 30 of the pumps 28 to extend therethrough and terminate substantially flush with an outer wall surface 7 of hoods 34. A collar 9 surrounding each nozzle 30 engages against a shouldered projection 11 surrounding opening 36. The hoods 34 preferably have an outer collar 38 that is supported by lower lip features 40 and 42 of the cabinet 26 when cover 48 is closed. Each hood 34 is slidably located in the cabinet base 50 by a T-shaped tab 44 that slides along a corresponding slot 46 of the base 50. A hood 34 can be removed from the base 50 by sliding the tab 44 up and out of the slot 46. The tabs 44 and slots 46 further support and align the hoods 34 within the cabinet 26.

The cabinet 26 comprises an outer cover 48 that is pivotally connected to a base 50. The base 50 typically has apertures (not shown) that allow the cabinet 26 to be mounted to the wall 12 by screws or the like or otherwise by strips of double sided adhesive tape. The cover 48 can be rotated between closed position and an open position to conceal and expose the cartridges 22, respectively. As shown in FIG. 1, the cover 48 has a plurality of discreet viewing apertures 52 that allow a user to view the level of cosmetic substance 14 within each cartridge 22 as the cartridge nears depletion.

FIG. 5 shows a latch 54 of the cover 38 that can be inserted into a corresponding slot 56 of the cabinet 26 to secure the cover 48 in the closed position. The latch 54 has a resilient finger 58 which can be deflected to allow the cover 48 to be rotated to the open position. Finger 58 is accessible for release by inserting a small pinlike object via an unobtrusive aperture 5.

FIG. 6 shows a pivot joint 60 for the cabinet 26. There are typically two cabinet pivot joints 60 in the dispenser 10. The cover 48 has a tab 62 that extends into a slot 64 of the base 48 and is captured by two base fingers 66. The cabinet cover 48 is preferably constructed from resilient plastics material which will deflect when the cover 48 is rotated to the open position or over-rotated to disengage cover 48 for removal.

For a cosmetic dispensing system employing disposable cartridges to be commercially viable, it is essential that the cost of the cartridge is kept to a minimum. Most of the prior art cosmetic dispensers employ a specially designed or fabricated pump and nozzle to suit a particular dispenser system. This adds substantially to cost.

In the present invention, it has been found surprisingly that with suitable modifications a commonly available dispenser pump normally employed with upright hand held dispensers can be used effectively in an inverted position without leakage as might otherwise be expected.

Such dispenser pumps are normally employed with containers of window or other surface cleaners and screw threadably engage with the threaded neck of a glass or plastic bottle with the pump body located in the neck of the bottle. The pump has a spray nozzle at its upper end with one or more fine orifices to generate a fine mist.

The pump is actuated by downward thumb or finger pressure on the top of the nozzle body to produce a mist spray at right angles to the axial direction of reciprocating pump motion. The pump cylinder includes an inlet port at its lower end to which a flexible tube is attached to provide a supply of non viscous liquid from the bottom of the bottle.

To avoid the formation of a vacuum within the bottle as the liquid level diminishes, vent ports are provided near the top of the pump cylinder to allow ingress of air into an annular cavity between the inside wall of the bottle neck and the outer wall of the pump body.

A check valve comprising a normally gravitationally seated metal sphere prevents drainage of fluid from the feeder tube between pump strokes or between uses to avoid the necessity of re-priming the pump each time.

When such a spray container is inverted however, the check valve is unseated allowing liquid to flow into the pump chamber from the feeder tube as well as via the vent ports. Liquid collecting in the pump chamber on the upper side of the pump piston then leaks from the container via the piston rod aperture in the valve cap.

While at first blush, there would be no reason to contemplate the use of such a pump system in an inverted dispenser of viscous cosmetic liquids, the present invention demonstrates the manner in which such a readily available and inexpensive "off-the-shelf" system can be so employed.

Figure 7:
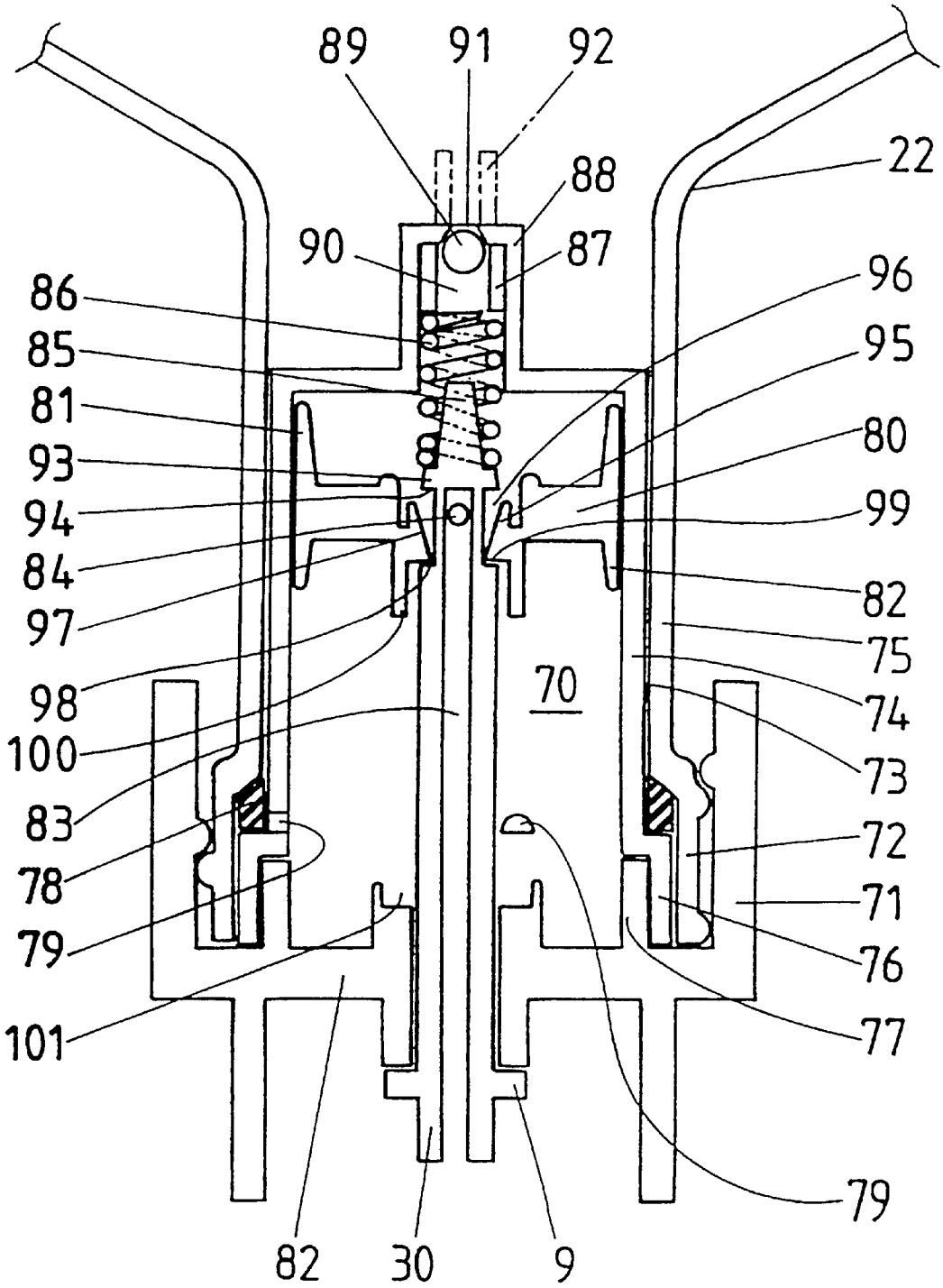
FIG. 7 is an enlarged cross-sectional side view of the dispenser pump in a retracted position.
Figure 8:
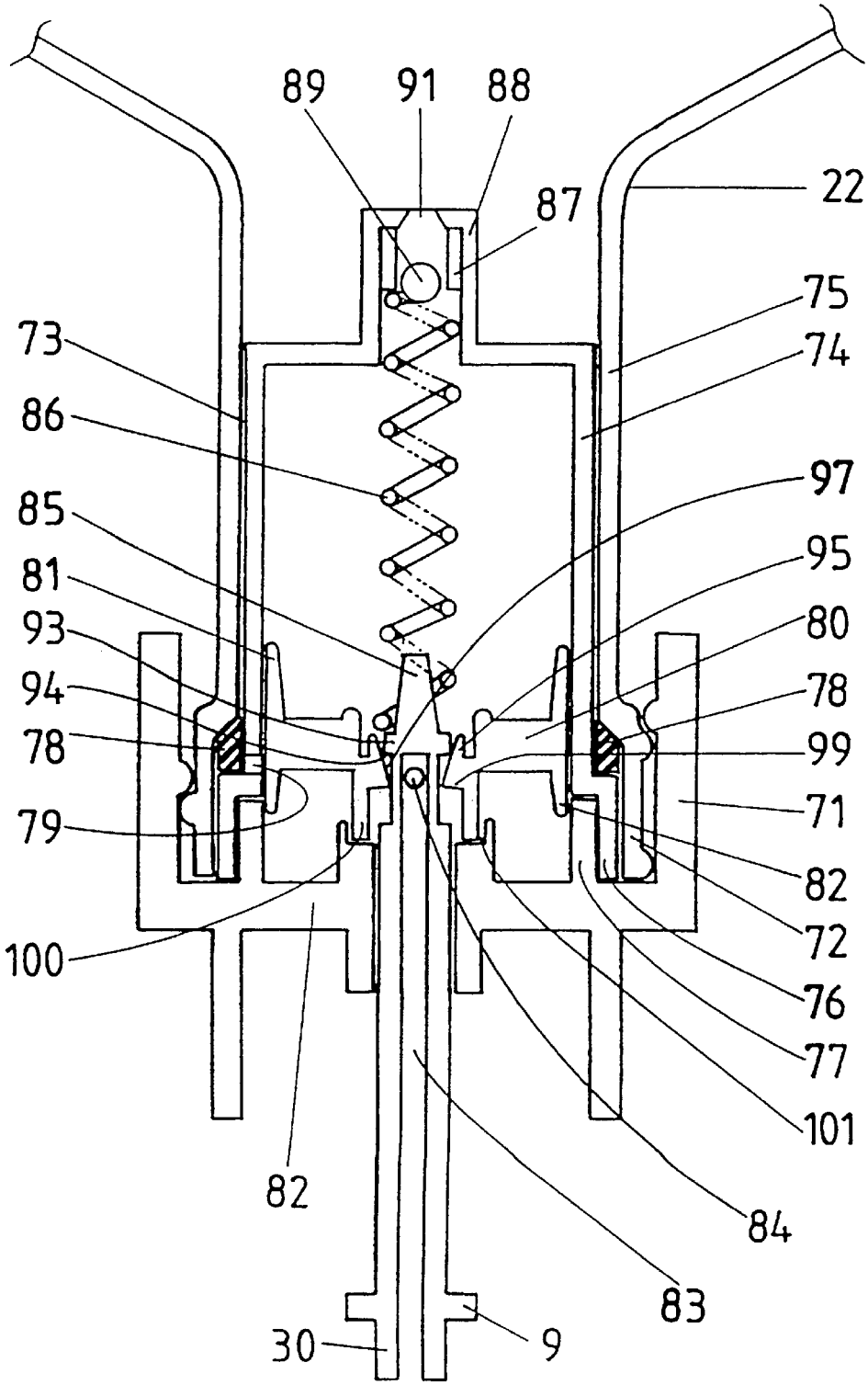
FIG. 8 is an enlarged cross-sectional side view of the dispenser pump in an extended position.

FIGS. 7 and 8 show a dispensing pump system according to the invention in a retracted dispensing position and an extended rest position.

In FIG. 7, the dispenser pump 70 is frictionally engaged within the neck of cartridge 22 and is retained therein by screw threaded engagement between cap 71 and the threaded end 72 of cartridge 22.

A fluid tight seal is effected between pump 70 and cap 71 by the tight frictional engagement between the outer wall 73 of pump body 74 and the inner wall surface of cartridge neck 75. The lower region 76 has a tight frictional engagement with a mounting flange 77 integrally formed with cap 71 and a resilient rubber band 78 encircling air vents 79 is compressed between wall 73 of pump body 74 and the inner wall surface of cartridge neck 75.

It can be seen therefore that there is a tight fluidic seal between the interior of cartridge 22 and pump body 74 which prevents any leakage of liquid from the pump to when in an inverted position.

Pump 70 comprises a double acting piston 80 of a soft resilient plastics material with an upwardly extending flange 81 and a downwardly extending flange 82. Dispensing nozzle 30 is slidably supported in base 82 of pump 70 and includes a hollow tubular portion 83 with inlet ports 84 at the upper end of the tubular portion 83. On the upper end of tubular portion 83 is a tapered head 85 which located one end of a helical coil spring 86, the upper end of which abuts against a shoulder 87 in inlet nozzle 88.

A check valve in the form of a spherical steel ball 89 is located for free movement in a chamber 90 having a tapered inlet orifice 91. The conventional dispenser pump 70 is further modified by removal of flange 92 (shown in phantom) which normally locates a feeder tube employed in a conventional top mounted pump dispenser bottle. Similarly the spray nozzle (not shown) is removed from its frictional engagement with the free end of nozzle 30, collar 9 acting in use to support the nozzle 30 and also to act as a limiter for the stroke of the pump to avoid damage to piston 80.

At the base of tapered head 85 is a flange 93, the upper shoulder of which supports coil spring 86 and the lower edge 94 of which forms a fluidic seal with the inner wall 95 of a frusto conical aperture 96 in piston 80.

A narrow cylindrical neck 97 is formed in the region of inlet ports 84 between the lower edge 94 of flange 93 and a shouldered abutment 98 formed on tubular portion 83.

As can be seen from FIGS. 7 and 8, piston 80 is supported on shouldered abutment 98 during an upward dispensing stroke by a shouldered projection 99 at the base of frusto conical aperture 96.

During an upward dispensing stroke, inlet ports 84 are exposed and check valve 89 moves to a closed position thus forcing liquid into inlet ports 84 via tubular portion 83 to nozzle 30.

As upward pressure on nozzle 30 is released, the biassing influence of spring 86 moves tubular portion downwardly.

As the frictional engagement of the piston 80 with the inner wall of pump 70 is greater than the frictional engagement between cylindrical neck 97 and frusto conical aperture 96, a limited amount of lost motion occurs between piston 80 and tubular portion 83.

As the lower edge 94 of flange 93 engages against the inner wall 95 of frusto conical aperture 96, inlet ports 84 are thus fluidically sealed from the inner region of pump 70 on the upper side of piston 80 and piston 80 moves to the position shown in FIG. 8 under the biassing influence of spring 86 acting on tubular portion 83.

As piston 80 begins to move downwardly, reduced pressure within the pump 70 above the piston 80 causes check valve 89 to open and the liquid cosmetic substance in the cartridge 22 enters the pump body. Air compressed on the lower side of piston 80 is expelled via a slight clearance between tubular portion 83 and pump base 82 without any leakage of cosmetic substance which would otherwise occur if air vents 79 were not sealed.

When the piston reaches a rest position as shown in FIG. 8 a lower flange 100 locates in a recessed socket 101 which limits the travel of piston 80 and supports it against the pressure of spring 84 urging the sealing engagement between the lower edge 94 of flange 93 and the frusto conical wall 95 of central piston aperture 96.

In the unlikely event of a breach, in the rest position, of the primary seal between edge 94 and wall 95, the inlet ports 84 are located above a secondary seal between the lower edge of wall 95 and cylindrical neck 97 whereby any leakage will flow to nozzle 30 rather than into the lower region of the pump body.

It will be readily apparent to a person skilled in the art that with appropriate modifications as described, a commonly available and inexpensive dispensing pump, otherwise quite unsuitable for use in an inverted position with a viscous cosmetic liquid, surprisingly can provide a reliable dispensing system with superior sealing against leakage.

In operation, a user presses upwardly on hoods 34 to discharge a finite volume of cosmetic substance onto the user's hand. As shown in FIG. 2, the hoods 34 each have a forwardly directed recess 68 surrounding the free end of a respective nozzle 30 to direct the substance gently to the user's hand toward the palm region without splash or splatter thereby maintaining the nozzles 30 and hoods 34 free from contamination. Hotel personnel can periodically inspect the dispenser 30 via the apertures 32 to determine the level of cosmetic substance 14 within each cartridge 22. When the level of a cosmetic substance has fallen below the aperture 52, the dispenser can be replenished by opening the cover 48, pulling the depleted cartridge 22 out of the cabinet 26, and snapping a new full cartridge 22 back into the finger 32.

Cartridges 22 include a removable seal (not shown) for air vent 6 to prevent spillage or leakage during filling, transportation and storage of filled cartridges. Typically the seal may comprise a removable adhesive tape or a frangible protrusion formed during a blow moulding process. Preferably the seal is formed by a small thin walled nipple which may be cut or torn from the cartridge when it has been inverted. The air vent makes such a cartridge difficult to refill via the cartridge filler neck due to leakage in the upright position or via the small air vent aperture due to the viscosity of the cosmetic liquids. Sanitation standards are thus maintained by reducing the temptation to try to refill the otherwise disposable container. Similarly there is no temptation to steal the cartridge due to the risk of leakage from the air vent 6. The hood 34 may also be removed, cleaned and re-attached to the cabinet 26 if required. The dispenser 10 of the present invention provides a sanitary and cost efficient means for dispensing cosmetic substances.

Similarly, while certain preferred embodiments have been described with reference to the accompanying drawings, it should be understood that many modifications or variations may be made to the invention without departing from the spirit and scope thereof.

For example, instead of locating the cartridges 22 and their attendant nozzle hoods 34 in the base 50 of cabinet 10, the cartridges and hoods may be mounted in the pivotal cover 48.

I claim:

1. A low maintenance cosmetics dispenser comprising:

a housing having a base member and a releasably securable cover member pivotally attached thereto to define a hollow interior;

one or more non-refillable disposable cosmetic cartridges removably securable in an inverted position within said hollow interior, said one or more cosmetic cartridges each having a reciprocal piston pump sealingly engaged in a dispensing neck of a respective cartridge, said pump in use being actuable by depression along an upright axis of a hollow dispensing nozzle connected to a piston of said pump, said one or more disposable cosmetics cartridges each including an air vent with a removable sealing member adjacent a respective cartridge base opposite a respective dispensing neck, said air vent being fluidically sealed during filling of a cartridge with a cosmetics substance and subsequently during storage and transportation, said air vent being operable when said cartridge is in an inverted in use position thereby rendering said cartridge non-refillable, said pump being characterized in that in a rest position, said dispensing nozzle is fluidically sealed from a fluid chamber of said pump; and, a nozzle hood associated with a respective nozzle, said nozzle hood being slidably engagable with said housing and said nozzle for actuation thereof.

2. A cosmetics dispenser as claimed in claim 1 wherein the nozzle hood is captively engaged with said housing when said cover member is closed and releasable when said cover member is open.

3. A cosmetics dispenser as claimed in claim 1 wherein the nozzle hood includes a nozzle aperture in a lower face to receivably locate a free end of a respective nozzle, said pump in use being actuable by depression of said nozzle hood.

4. A cosmetics dispenser as claimed in claim 3 wherein said nozzle hood includes a forwardly facing recess surrounding said nozzle aperture to direct, in use, a cosmetics substance onto a user's fingers in the direction of a user's palm.

5. A cosmetics dispenser as claimed in claim 1 wherein said cover member and said base member are releasably securable in a closed position by a latch member.

6. A cosmetics dispenser as claimed in claim 5 wherein the latch member is hidden when the cover member is closed and an unobtrusive access is provided for release of said latch member.

7. A cosmetics dispenser as claimed in claim 1 wherein said one or more cartridges are secured in said housing by resiliently deformable latch fingers associated with said housing.

8. A cosmetics dispenser as claimed in claim 7 wherein said one or more cartridges are secured in said housing by resiliently deformable spring latch fingers releasably engagable with corresponding contours on a surface of said one or more cartridges.

9. A cosmetics dispenser as claimed in claim 1 wherein said removable sealing member is adhesively secured to a respective cartridge.

10. A cosmetics dispenser as claimed in claim 1 wherein said removable sealing member comprises a severable hollow protrusion extending outwardly of a wall of a respective cartridge.

11. A cosmetics dispenser as claimed in claim 1 wherein said piston pump is integrally formed with a screw threaded closure sealingly engagable with a screw threaded neck on a respective cartridge.

12. A cosmetics dispenser as claimed in claim 11 wherein the piston pump comprises a cylindrical body sealingly engagable with the neck of a respective cartridge.

13. A cosmetics dispenser as claimed in claim 12 wherein said piston pump is characterized by the absence of operative air vents communicating between a normally lower region of the pump body and the interior of a respective cartridge.

14. A cosmetics dispenser as claimed in claim 13 wherein the piston pump is in fluid communication with the interior of a respective cartridge only via a check valve located in a normally upper portion of said pump body.

15. A cosmetics dispenser as claimed in claim 14 wherein the piston pump comprises a dispenser pump adapted for use with a top dispensing container, said dispenser pump having air vents provided in the pump body adjacent one end, remote from a check valve located at an opposite end, that are fluidically sealed.

16. A cosmetics dispenser as claimed in claim 15 wherein the air vents are fluidically sealed by an elastomeric seal located between the pump body and an interior wall of a respective container.

17. A cosmetics dispenser as claimed in claim 16 wherein the dispenser pump is further characterized by the removal of a feeder tube spigot adjacent the check valve.

18. A cosmetics dispenser as claimed in claim 17 wherein a lost motion connection between said piston and said dispensing nozzle permits opening of a normally closed fluid pathway between said nozzle and said fluid chamber upon depression of said nozzle.

* * * * *